United States Patent [19]

Bardon et al.

[11] 4,143,199

[45] Mar. 6, 1979

[54] TEXTILE ELEMENTS OF NODULAR APPEARANCE, PROCESSES FOR THEIR MANUFACTURE AND ARTICLES PRODUCED WITH SUCH ELEMENTS

[75] Inventors: Pierre Bardon, Ecully; Rene Guillermin, Bron; Jean Joly, Craponne, all of France

[73] Assignee: Rhone-Poulenc-Textile, Paris, France

[21] Appl. No.: 733,857

[22] Filed: Oct. 19, 1976

[30] Foreign Application Priority Data

Oct. 20, 1975 [FR] France ..... 75 32243

[51] Int. Cl.[2] ..... D02G 3/00

[52] U.S. Cl. ..... 428/369; 428/362; 428/370; 428/399; 428/400

[58] Field of Search ..... 428/399, 369, 370, 362, 428/360, 296, 197, 400, 364; 57/140 BY, 140 R

[56] References Cited

U.S. PATENT DOCUMENTS

| | | | |
|---|---|---|---|
| 3,091,913 | 6/1963 | Field | 57/140 BY |
| 3,103,098 | 9/1963 | Dyer | 428/399 X |
| 3,402,096 | 9/1968 | Blanchette | 428/369 |
| 3,473,315 | 10/1969 | Le Noit | 428/401 X |
| 3,828,542 | 8/1974 | Boutonnet et al. | 428/369 X |
| 3,857,230 | 12/1974 | Rasmussen | 57/140 BY X |
| 3,999,366 | 12/1976 | Heichlinger et al. | 428/399 X |

*Primary Examiner*—Lorraine T. Kendell

[57] ABSTRACT

The invention relates to elongated textile elements having one or more thickened portions along its length, processes for their manufacture and the articles produced with such elements.

The element is characterized in that it consists of an assembly of substantially parallel yarns of high bulk, which possesses, over its length, at least two compressed zones of low diameter separated by a bulky zone of high diameter.

These elements, used by themselves or in association with other materials, make it possible to obtain very decorative articles suitable for garments and especially for furnishings such as tapestries, wall coverings, seat covers and the like.

15 Claims, 3 Drawing Figures

TEXTILE ELEMENTS OF NODULAR APPEARANCE, PROCESSES FOR THEIR MANUFACTURE AND ARTICLES PRODUCED WITH SUCH ELEMENTS

FIELD OF THE INVENTION

The present invention relates to elongated textile elements of nodular appearance, processes for their manufacture and the articles produced using these elements.

DISCUSSION OF PRIOR ART

It is known, in the textile industry, to produce yarns, which may be continuous yarns or spun fibres, having a nodular appearance, that is to say exhibiting more or less widely spaced nodules over their length. These fancy yarns are used for producing woven fabrics or knitted fabrics employed in garments and in furnishing (curtains, tapestries, wall coverings, seat covers and the like).

U.S. Pat. No. 3,129,485 (Shattuck, et al.) relates to a process and apparatus for making regularly or irregularly bulky yarns in which the yarns are individually treated by an air jet.

U.S. Pat. No. 3,284,871 (Yano, et al.) relates to intermittently crimped filaments and the method of their production.

However, the use of these yarns is restricted by the fact that they have a low diameter and the process and apparatus for their production are complicated.

A new textile element of very decorative nodular appearance, the processes of manufacture of which is simple to carry out, has now been found.

Accordingly, the invention relates in one aspect to elongated textile element of nodular appearance, which consists of an assembly of substantially parallel yarns of high bulk, which exhibits, over its length, at least two compressed zones of relatively low diameter separated by a bulky zone of relatively high diameter.

According to one embodiment, the simplest textile element is in the form of a single nodule with two compressed zones located at the two ends and separated by a bulky zone of high apparent diameter. In another embodiment, the textile element can also comprise a succession of compressed zones of identical or non-identical length, distributed along the assembly in a regular or irregular manner, but over its entire thickness. These can be obtained, for example, by simple tieing of the assembly by means of a ring or other tubular means, which may be slidable, and may be made of any textile material, for example a heat-shrinkable yarn, metallic material, wood, plastic, paper, and the like, or can be obtained by applying a curable binder, a wire or any other similar means, by heat-welding, by simple interlacing of yarns, and the like. The bulky zones located between the compressed zones are in the shape of a nodule, of identical or different diameters, and the length of these zones can be less than, greater than or equal to that of the compressed zones.

According to the second aspect, the invention relates to a process for obtaining the abovementioned textile element, which is characterized in that an assembly of substantially parallel yarns of high bulk is placed under tension, compressed zones are created over the entire thickness of the assembly, intermittently over its length, and the tension is relaxed.

Another embodiment of a process according to the present invention, which is particularly valuable if yarns having a latent crimpability are used, is characterized in that yarns having a latent crimpability are assembled in parallel, compressed zones are created over the entire thickness of the assembly and intermittently over its length, and the yarns are subjected to a crimp-developing treatment.

The process described above provides a textile element exhibiting a succession of nodules. The assembly can thereafter be cut at the position of the compressed zones so as to separate off one or more nodules.

The textile element according to the invention is particularly valuable for the manufacture of garments or of furnishing articles, for example for the manufacture of curtains, tapestries, partitions, various wall coverings, lampshades and the like, because it exhibits a very marked decorative effect. It can be used by itself, for example to form a woven fabric of loose construction which can be used for garments, or in association with other materials such as wood, plastics, other textiles and the like. The textile elements possessing a single nodule make it possible to obtain a great variety of articles because there are numerous possible ways of assembling such elements. It is possible to use nodules of different colors and of different sizes, to thread them up, like beads, on any carrier (a metal wire or plastic thread), or to glue them by their ends, or by a part of the bulky zone, into a support, so as to obtain very decorative textile surfaces.

DETAILED DESCRIPTION OF THE INVENTION

As used in the present specification and claims, the term "yarns of high bulk" are to be understood to include both continuous filaments and discontinuous fibers which possess a low density and a high apparent volume, and are based on any starting material of natural, artificial or synthetic origin, it being possible for the discontinuous fibers to be in the form of roving, sliver or spun yarns, while the continuous filaments can be in the form of tows or be wound together, these forms being used separately or in combination.

The high bulk yarns used are generally yarns which, in the finished textile article, are crimped, the crimp being produced either before or at the last stage of manufacture of the textile article of the invention. The yarns which have been crimped before the manufacture of the article can be obtained by a great diversity of processes. Among these there may be mentioned twisting processes, for example the conventional bulking process, the false twist process, the set false twist process and the like, mechanical or pneumatic processes, processes of deformation by passing over a blade together with heat treatment, by hot drawing over a gear-wheel, or by knitting and unknitting (the K.D.K. process), and processes involving looping by means of compressed air jets; "high bulk" type spun yarns wherein the fibers have different shrinkages, and, finally, composite yarns of the two-layer type, obtained by spinning two synthetic polymers of different chemical constitution, are also suitable.

The yarns of which the crimp is developed at the last stage of manufacture of the article according to the invention are yarns which possess a latent crimpability, and of which the crimp is developed by a heat treatment or chemical treatment. As examples of these types of yarns there may be mentioned composite yarns of the two layer type, or mixtures of shrinkable fibers (based on vinyl chloride) and non-shrinkage fibers all of which are well known in the art.

The textile articles which possess a succession of several nodules are particularly valuable for the manufacture of tapestries and insulating partitions or decorative partitions, because it suffices to cut the elements to the desired length and to attach them at one or both ends to a rigid element.

Where slidable elements, for example rings, are used as the means for compression, it can be of value to vary the dimensions of the nodules at will. Furthermore, it should be indicated that since the textile element is relatively simple to manufacture, a non-specialist would be able to produce by himself, and to suit his taste, a decorative article from an assembly of high bulk yarns and simple means of compression such as wooden beads, adhesive tapes, or simple ligatures employing a textile tie.

Figure 1:
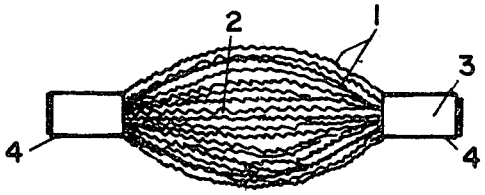
FIG. 1 shows a single-nodule textile element according to the present invention.

FIG. 1 shows a single-nodule textile element consisting of an assembly 1 of substantially parallel yarns and possessing a bulky zone 2 and two zones 3 which are compressed by means of clamping rings 4.

Figure 2:
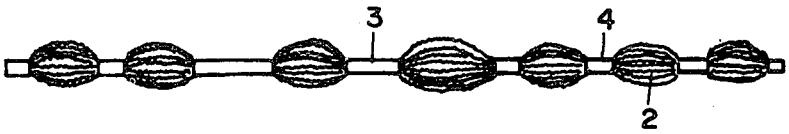
FIG. 2 shows a textile element having a plurality of compressed zones and the bulky (nodular) zones.

FIG. 2 shows a textile element consisting of a series of nodules 2 between compressed zones 3.

Figure 3:
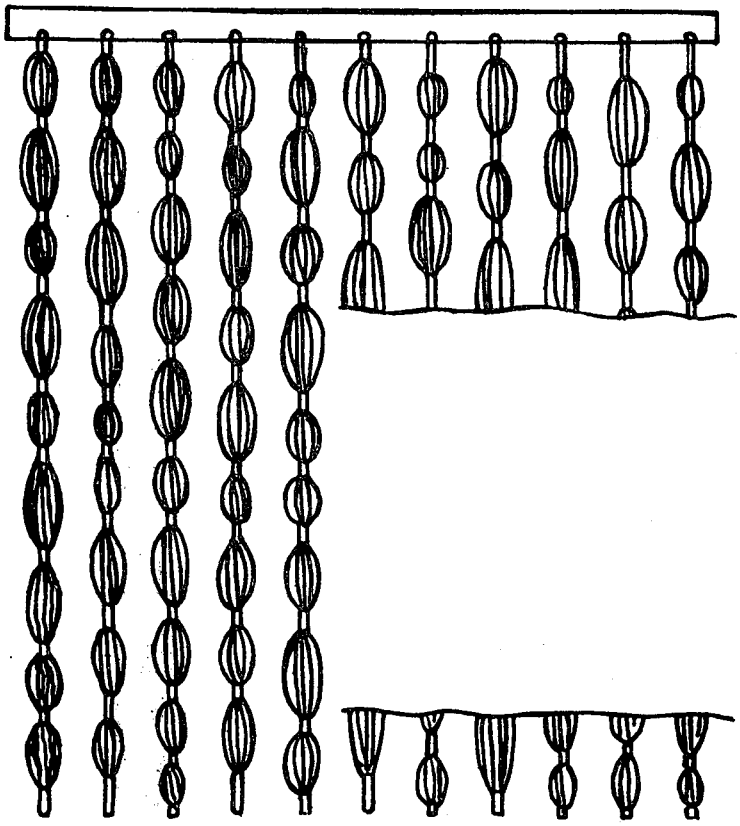
FIG. 3 shows a decorative curtain formed from a series of textile elements such as shown in FIG. 2.

In FIG. 3, a plurality of multi-nodular textile elements are each attached at one end thereof, corresponding to a compressed portion of the element, to a rigid or fixed member whereby the elements for a decorative partition or panel. For example, by attaching a series of the elongated textile elements of the present application to the overhead cross piece of a doorway or to the ceiling or beam between two sections of a room, an attractive room divider can be obtained. Of course, the elements can be fixed at both ends, such as upon a wall to form a decorative panel.

Although the lengths and apparent diameters of the compressed zones 3 and bulky zones 2 are not critical with respect to the decorative effects of the elongated textile elements, it is preferred that the ratio between the apparent diameter, i.e. the diameter under relaxed conditions of the compressed zone and bulky zone is within the range of from 2 to 1 to about 50 to 1.

The number of used high bulked yarns to form nodular appearance of the textile elements, and the device of these yarns depend of the presentation of the yarn as explained above and on the intended application.

The present application will now be described in further detail by the following illustrative examples which are intended as representative of and not limiting the scope of the present invention.

EXAMPLE I

A bundle is formed from 40 continuous yarns of polyhexamethylene adipamide each of gauge 2,800 dtex (2,500 den)/136 strands and of unbleached white color, the yarns having been texturized by pneumatic means such as those described in U.S. Pat. No. 3,482,294; this bundle is then placed under tension, and pinched zones are then created by wrapping with a pink yarn of the same constitution, the turns being placed side by side, sometimes over a length of three centimeters and sometimes over a length of five centimeters. The tension is then relaxed; and elongated textile element such as that shown in FIG. 2 is obtained. Several of these elements, placed side by side and held at the same end produce a curtain-type panel (see FIG. 3) which can be placed in front of a window or fixed, as a decorative element, to a wall or form a room divider.

EXAMPLE 2

A tow of 480 two-layer yarns each of 400 dtex (360 den), which are crimped and are made from a polymer consisting of 50% of poly(ethylene terephthalate) crosslinked with 0.65 mol% of trimethylol propane and 50% of poly(butylene terephthalate) crosslinked with 0.3 mol% of trimethylol propane, is made up; it is placed under tension and rings formed of colored plastic tubes of different colors and lengths are then threaded into this tow and arranged irregularly along the said stretched tow. Thereafter the tension is relaxed. Several of the elements obtained are joined side by side as in Example 1 to form a panel which can be placed in front of a window or fixed to a wall as a decorative element. It should be noted that the effect obtained can be varied by using slidable rings.

EXAMPLE 3

A yarn of poly(ethylene terephtahalate) of 1,100 dtex (1,000 den) formed by assembling 200 filaments and texturized by pneumatic means such as are described in U.S. Pat. No. 3,482,294 is placed under tension. Compressed parts of two centimeters length, spaced at intervals of 12 centimeters, are created in the yarn by depositing a neoprene glue. The glue is allowed to dry in air for 5 minutes and the tension is then relaxed. The element obtained is woven in a plain weave so as to give a furnishing fabric having a very decorative appearance.

EXAMPLE 4

A yarn of poly(hexamethylene adipamide) of 2,800 dtex (2,500 den), formed by assembling 136 filaments, and texturized by pneumatic means such as those described in U.S. Pat. No. 3,482,294 is kept in the tensioned state. Compressed zones of about 1.5 centimeters, spaced at intervals of 10, 5 and 25 centimeters, are created by means of a pneumatic knotting gun. Several elements thus obtained are glued side by side, by means of neoprene glue, onto a paper web. A very decorative texturized wall covering is obtained.

EXAMPLE 5

A spun yarn of metric number 6, and coefficient of twist 50 is produced; it consists of 80% of wool fibers of mean length 80 mm and 20% of fibers obtained by spinning a mixture of polyvinyl chloride and chlorinated polyvinyl chloride (in the ratio 80/20), trademark CLEVYL F, which fibers have a shrinkage of 35% in boiling water, an elongation at break, in the shrunken state, of 60% and lengths ranging from 60 to 100 mm. After spinning, three ends of this spun yarn are twisted together in the opposite direction to that of the spinning twist, so as to reduce the degree of twist (coefficient of twist 42).

Four yarns thus obtained are assembled and held under tension. Compressed zones are created every 2, 4 and 10 centimeters by means of a metal spiral. The assembly is treated in an oven containing steam at 105°

C. so as to cause the shrinkage of the vinyl fibers and cause the bulking-up of the non-compressed zones.

The textile element obtained is used as in Example 1 for the manufacture of a wall hanging which in addition to its decorative appearance has the advantage of exhibiting good fire resistance.

EXAMPLE 6

350 crimped composite yarns of the two-layer type, each of 500 dtex (450 den), the yarns being crimped and made of a polymer consisting of 50% of poly(ethylene terephthalate) crosslinked with 0.65 mol% of trimethylolpropane and 50% of poly(butylene terephthalate) crosslinked with 0.3 mol% of trimethylolpropane, are assembled. Compressed zones located every 4 and 12 centimeters are created on the assembly, which is kept in the tensioned state, by means of a heat-shrinkable tubular jersey fabric produced with a vinyl chloride-based yarn, which is then heat treated at 110° C. The textile element obtained is used as in Example 1 for the manufacture of a decorative wall hanging.

EXAMPLE 7

A yarn of 2,400 dtex (2,150 den), formed by assembling 1,200 two-layer filaments made from a polymer consisting of 50% of poly(ethylene terephthalate) cross-linked with 0.65 mol% of trimethylolpropane and 50% of poly(butylene terephthalate) cross-linked with 0.3 mol% of trimethylolpropane, is kept in the tensioned state. It is ligatured every 7 and 12 centimeters, without making a knot, with a coil of a heat-fusible yarn consisting of a terpolymer of hexamethylene sebacamide, para-aminocyclohexylmethane adipate and caprolactam. The yarn is passed through an air jet, the air being heated to 130° C., to cause the heat-fusible yarn to melt and to develop the crimp of the two-layer yarn. The textile element obtained is used as in Example 1 to manufacture a decorative panel.

Having described certain representative embodiments and details for purpose of illustrating the present invention, it will be apparent to those having skill in this art that various changes and modifications can be made without departing from the spirit and scope of the invention defined in the appended claims.

What we claim is:

1. An elongated decorative textile element of nodular appearance, comprising an assembly of substantially parallel polyamide or polyester yarns of high bulk, which possesses, over its length, at least two compressed zones of low diameter separated by a bulky zone of high diameter in which the ratio of the apparent diameters of the compressed zone and bulky zone is within the range of from 2 to 1 to about 50 to 1 said assembly having a total denier of at least about 100,000.

2. The elongated textile element of nodular appearance, according to claim 1, which comprises a single nodule consisting of two compressed zones of low diameter at the ends of said element, separated by a bulky zone of high diameter.

3. The elongated textile element of nodular appearance, according to claim 1, which comprises a series of nodules which consists of at least three compressed zones of low diameter, each compressed zone separated from the preceding and succeeding compressed zone by a bulky zone of high diameter.

4. The elongated textile element according to claim 3, wherein the compressed zones are distributed regularly along the assembly.

5. The elongated textile element according to claim 3, wherein the compressed zones are distributed irregularly along the assembly.

6. The elongated textile element according to claim 3, wherein each of the compressed zones are of the same length.

7. The elongated textile element according to claim 3, wherein at least two of the compressed zones are of different lengths.

8. The elongated textile element according to claim 1, wherein the compressed zones and the bulky zones are of identical length.

9. The elongated textile element according to claim 1, wherein the length of the compressed zones is greater than that of the bulky zones.

10. The elongated textile element according to claim 1, wherein the length of the compressed zones is less than that of the bulky zones.

11. The elongated textile element according to claim 1, wherein the bulky yarns of the assembly are crimped yarns.

12. The elongated textile element according to claim 11, wherein the crimped yarns are composite yarns obtained by spinning two synthetic polymers of different chemical constitution.

13. The elongated textile element according to claim 1 which has a total denier of about 100,000 and is formed from polyamide yarns.

14. The elongated textile element according to claim 1 which has a total denier of about 157,500 and is formed from composite polyester yarns.

15. The elongated textile element according to claim 1 which has a total denier of about 172,800 and is formed from polyester yarns.

* * * * *